US005989766A

United States Patent [19]

Jeong et al.

[11] Patent Number: 5,989,766

[45] Date of Patent: Nov. 23, 1999

[54] PHOTOCONDUCTIVE COMPOSITION AND DISPLAY ADOPTING PHOTOCONDUCTIVE LAYER MADE THEREOF

[75] Inventors: Bong-mo Jeong, Kyungki-do; Min-chul Suh; Sang-chul Shim, both of Taejon, all of Rep. of Korea

[73] Assignee: Samsung Display Devices Co., Ltd., Kyungki-do, Rep. of Korea

[21] Appl. No.: 09/093,058

[22] Filed: Jun. 8, 1998

[30] Foreign Application Priority Data

Jun. 9, 1997 [KR] Rep. of Korea ..... 97-23655
Dec. 22, 1997 [KR] Rep. of Korea ..... 97-72030

[51] Int. Cl.[6] ..... G03G 5/04; G03G 5/09

[52] U.S. Cl. ..... 430/83; 430/56

[58] Field of Search ..... 430/56, 83

[56] References Cited

U.S. PATENT DOCUMENTS

| | | | |
|---|---|---|---|
| 3,408,189 | 10/1968 | Mammino | 430/83 |
| 3,512,966 | 5/1970 | Shattuck et al. | 430/83 |
| 3,772,011 | 11/1973 | Guevara et al. | 430/56 |
| 3,879,201 | 4/1975 | Williams et al. | 430/83 |
| 3,935,009 | 1/1976 | Crommentuyn et al. | 430/83 |
| 4,264,695 | 4/1981 | Kozima et al. | 430/83 |
| 4,535,042 | 8/1985 | Kitayama et al. | 430/56 |

*Primary Examiner*—Roland Martin
*Attorney, Agent, or Firm*—Leydig, Voit & mayer, Ltd.

[57] ABSTRACT

A photoconductive composition and a display device adopting a photoconductive layer formed of the composition. The photoconductive composition includes an electron donor, an electron acceptor, a charge transmitting substance, a binder, a surfactant and a solvent, and the photoconductive composition is characterized in that a 1,4-diphenyl-1-butene-3-yne derivative is used as the electron donor. The photoconductive composition has excellent sensitivity and thermal decomposition property. Thus, there are scarcely residues left after the sintering process, thereby effectively preventing deterioration in image quality of a display device.

9 Claims, 3 Drawing Sheets

PHOTOCONDUCTIVE COMPOSITION AND DISPLAY ADOPTING PHOTOCONDUCTIVE LAYER MADE THEREOF

BACKGROUND OF THE INVENTION

1. Field of the Invention

The present invention relates to a photoconductive composition and a display device adopting a photoconductive layer made of the composition, and more particularly, to a photoconductive composition for a photoconductive layer by an electrophotographic technique and a display device adopting a photoconductive layer made of the composition.

2. Description of the Related Art

A phosphor screen of a color cathode ray tube (CRT) is formed by a slurry coating method or an electrophotographic process.

According to the slurry coating method, a panel is cleaned, and then slurries of primary colors (i.e., red, green and blue) emitting phosphors are respectively coated on the panel. Each phosphor slurry contains polyvinylalcohol, one of the red-, green- and blue-emitting phosphors, and ammonium dichromate. After exposing a predetermined portion of the panel to light using a shadow mask, a developing process is performed to form a phosphor screen in a dotted or striped pattern.

However, the slurry coating method has the following problems.

First, the phosphor remains at an unexposed portion after the exposing and developing processes, so that the remaining phosphor is mixed with a phosphor to be coated later.

Second, a coloring substance is generated by the reaction between the hydroxy group of polyvinylalcohol and ammonium dichromate which are contained in the phosphor slurry, thereby lowering purity in color.

As Another method for manufacturing the phosphor screen for CRT, a method using an electrophotographic technique is known, The method is simple in process compared with the above-described slurry coating method, and can provide a color CRT having excellent luminescent characteristic.

In this method, a conductive layer is first formed on a CRT panel which has been cleaned, and a photoconductive layer is formed thereon.

Then, the photoconductive layer is electrified using a corona charger, and a predetermined portion thereof is then exposed through a shadow mask. After neutralizing electric charge of the exposed portion, one of red, green and blue phosphor compositions is adhered to the exposed portion thereof and then fixed to the inner surface of the panel. Then, by repeating the above steps, the remaining phosphor compositions are fixed on the inner surface of CRT panel, respectively, thereby completing a phosphor layer pattern On the other hand, a plasma display device is for displaying an image using a gas discharge phenomenon. Since the plasma display device are excellent in display capacity, luminance. contrast an viewing angle properties, the plasma display device has been highlighted as a display device capable of replacing the CRT. In the plasma display device, gas discharging occurs between the electrodes by a DC or AC voltage applied to the electrodes, and the phosphor is excited by the accompanying ultraviolet rays' emission, thereby emitting light.

The plasma display device is classified into two types according to a discharging mechanism: alternative current (AC) type and direct current (DC) type.

FIG. 1 is a schematic exploded perspective view showing the structure of a conventional AC type plasma display device.

Referring to FIG. 1, a first electrode 13*a* as a display electrode, and a second electrode as an address electrode are formed between a front substrate 11 and a rear substrate 12. Here, a plurality of first electrodes 13*a* and a plurality of second electrodes 13*b* are formed on the inner surfaces of the front substrate 11 and the rear substrate 12, respectively, with a stripped shape, crossing each other at a right angle.

A dielectric layer 14 and a passivation layer 15 are formed in sequence on the front substrate 11 having the first electrodes 13*a*. Also, a dielectric layer 14' is formed on the rear substrate 12 having the second electrode 13*b*, and a plurality of barrier wall 17 are formed on the dielectric layer 14.

A plurality of cells 19 are formed between the barrier walls 17, and the cells 19 are filled with an inert gas such as argon (Ar). Also, a phosphor screen 18 is formed at a predetermined portion of the cells 19.

In the above-described plasma display device, the barrier wall 17 is formed by a printing method where a material paste for the barrier wall is repeatedly deposited on the dielectric layer 14 formed on the rear substrate 12 using a blade coater. However, forming the barrier wall by the printing method causes the following problems.

First, the printing process of the barrier wall materials using the blade coater must be repeated so as to obtain a barrier wall having a predetermined thickness. That is, it takes a long time, lowering productivity.

Second, when coating the paste on the dielectric layer formed on the rear substrate and pressing the resultant structure using the blade coater, a screen mesh attached on the substrate is deformed by the pressure applied by the blade coater. If the screen mesh is deformed, it is impossible to form the barrier walls according to the designed pattern. That is, the shape of the completed barrier walls is distorted, thereby lowering quality of the image.

According to a method using an electrophotographic technique, as another method of forming the barrier walls of a plasma display device, a dielectric layer is formed on a rear substrate having address electrodes, and then a conductive layer and a photoconductive layer are formed on the dielectric layer in sequence.

After electrifying the surface of the photoconductive layer, a predetermined portion of the photoconductive layer is exposed to ultraviolet rays, thereby forming an electrostatic image.

By attaching composition for the barrier wall, i.e., toner composition, to the electrostatic image of the photosensitive film, the photoconductive layer is developed. During the developing process, the toner composition attached to the electrostatic image is dried, and the toner composition remaining the portion other than the electrostatic image is removed.

After repeating the steps of electrifying and developing the photoconductive layer, the rear substrate is sintered, completing the barrier walls.

A photoconductor as the major component of the photoconductive layer is roughly classified into an inorganic photoconductor and an organic photoconductor.

Generally, the inorganic photoconductor is toxic as well as poor in sensitivity, thermal stability, hygroresistance and durability. Also, the inorganic pnotoconductor results in much residue after the sintering process. In order to solve the problems, research into the organic photoconductor has been actively conducted. The organic photoconductor is lightweight, transparent and easy to sinter. Thus, the organic photoconductor has been mainly used when forming a fluorescent film of a CRT or barrier walls of a plasma display device using the electrophotographic technique.

However, the organic photoconductor has a low electrification potential, and poor charge generating and transmission abilities. Also, after sintering the organic photoconductor, residues also remain, thereby lowering image quality of a display device.

SUMMARY OF THE INVENTION

To solve the above problems, it is an objective of the present invention to provide a photoconductive composition containing an organic photoconductor having excellent thermal decomposition property.

It is another objective of the present invention to provide a display device capable of providing an excellent image quality, which adopts a photoconductive layer formed of the photoconductive composition.

To achieve the first objective, there is provided a photoconductive composition containing an electron donor, an electron acceptor, a charge transmitting substance, a bonding agent, a surfactant and a solvent, wherein the electron donor is a 1,4-diphenyl-1-butene-3-yne derivative represented by the following formula (1):

(1)

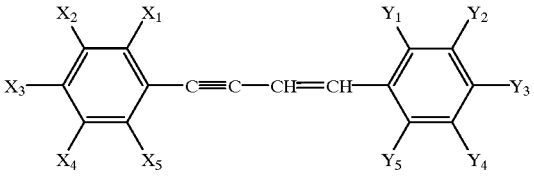

where $X_1$, $X_2$, $X_3$, $X_4$, $X_5$, $Y_1$, $Y_2$, $Y_3$, $Y_4$ and $Y_5$ are same or different independently from each other, each being selected from the group consisting of hydrogen and alkyl, phenyl, nitro ($NO_2$), $NR_2$, OR and $SiR_3$ groups, and R is hydrogen, alkyl or phenyl group.

To achieve the second objective, there is provided a display device adopting a photoconductive layer formed of the photoconductive composition. Preferably, the display device includes a bulb for a cathode ray tube (CRT) and a plasma display device which adopts the photoconductive layer formed of the photoconductive composition.

In detail, according to an aspect of the second objective, there is provided a bulb for a cathode ray tube (CRT) comprising a face plate on which a conductive layer, a photoconductive layer and a phosphor layer are sequentially formed, and a funnel is connected to the face plate and provided with an electron gun and a deflection yoke, wherein the photoconductive layer is formed by coating a photoconductive composition containing an electron donor represented by the following formula (1), an electron acceptor, a charge transmitting substance, a binder, a surfactant and a solvent, and drying the resultant.

(1)

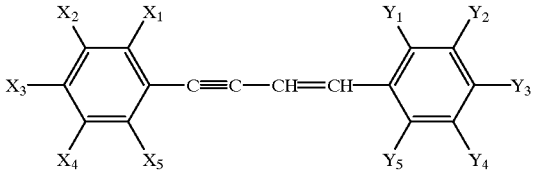

where $X_1$, $X_2$, $X_3$, $X_4$, $X_5$, $Y_1$, $Y_2$, $Y_3$, $Y_4$ and $Y_5$ are same or different independently from each other, each being selected from the group consisting of hydrogen and alkyl, phenyl, nitro ($NO_2$), $NR_2$, OR and $SiR_3$ groups, and R is hydrogen, alkyl or phenyl group.

According to another aspect of the second objective, there is provided a plasma display device comprising a substrate member on which electrodes, a dielectric layer, a conductive layer, a photoconductive layer and barrier walls are sequentially formed, wherein the photoconductive layer is formed by coating a photoconductive composition containing an electron donor represented by the following formula (1), an electron acceptor, a charge transmitting substance, a binder, a surfactant and a solvent, and drying the resultant.

(1)

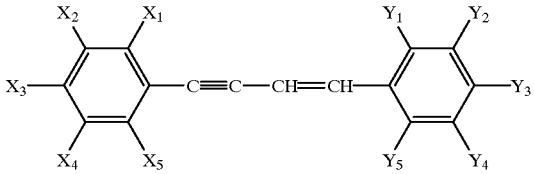

where $X_1$, $X_2$, $X_3$, $X_4$, $X_5$, $Y_1$, $Y_2$, $Y_3$, $Y_4$ and $Y_5$ are same or different independently from each other, each being selected from the group consisting of hydrogen and alkyl, phenyl, nitro ($NO_2$), $NR_2$, OR and $SiR_3$ groups, and R is hydrogen, alkyl or phenyl group.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
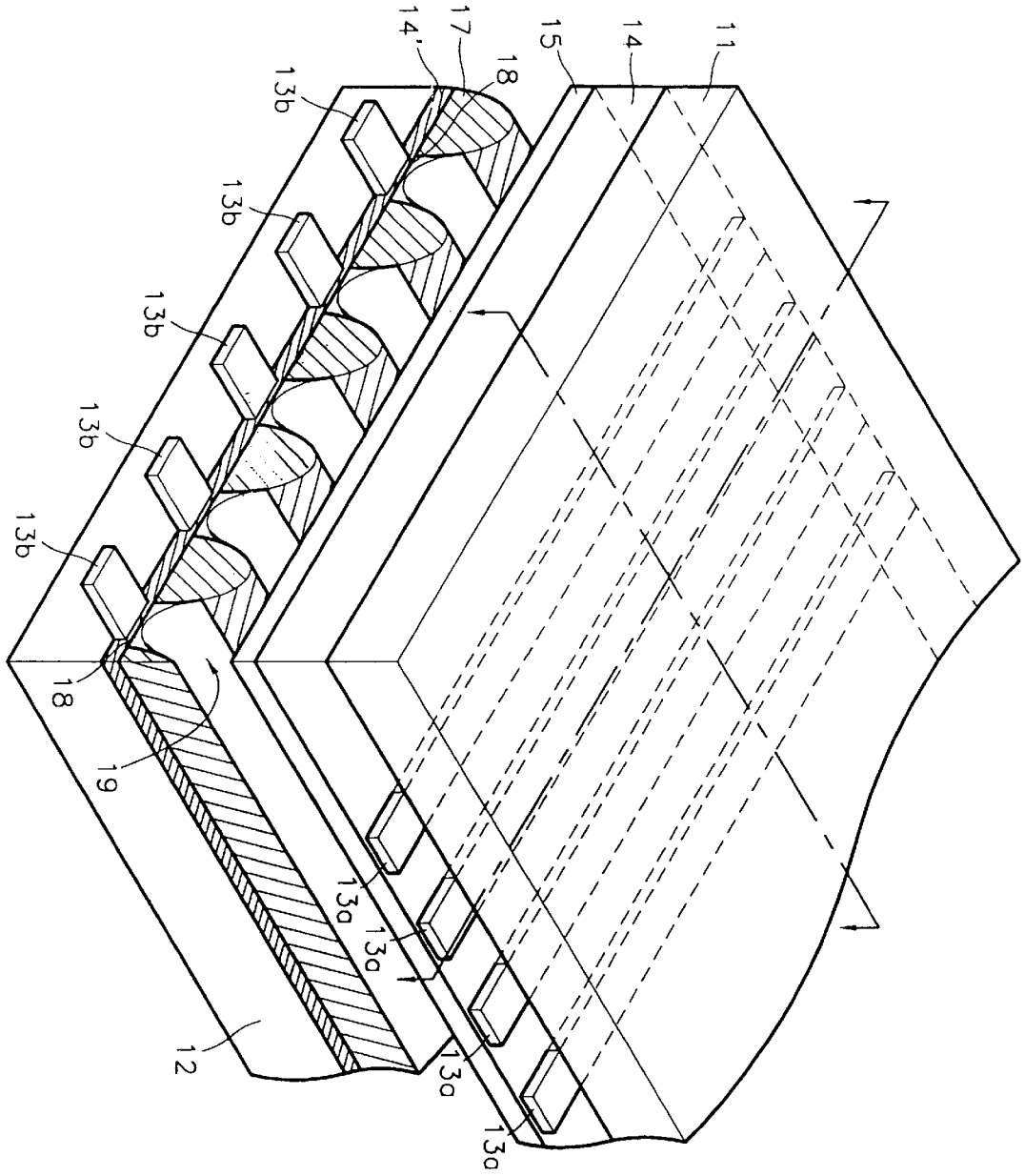
FIG. 1 is a schematic exploded perspective view of a conventional plasma display device.

A photoconductive composition contains an electron donor, an electron acceptor, a charge transmitting substance, a binder, a surfactant and a solvent. Each component of the photoconductive composition and the contents thereof will be described.

As the electron donor, a 1,4-diphenyl-1-butene-3-yne derivative represented by the formula (1) is used. Here, the compound may be a cis-, trans-, or mixture of the cis-. and trans-types without any limitation.

The content of the electron donor is 0.5~5 wt % based on the total weight of the photoconductive composition. If the content of the electron donor exceeds 5 wt %, excessive charge is generated from the electron donor so that the remaining charge, which could not form an charge transmitting complex with the electron acceptor, affects surface potential of the photoconductive layer, thereby increasing the residual potential. If the content of the electron donor is less than 0.5 wt %, the amount of charge generated from the electron donor is too less so that the charge transmitting complex is not formed actively.

The electron acceptor of the present invention is at least one selected from the group consisting of 4-nitroaniline, 2,4-dinitroaniline, 5-nitroanthranilonitrile, 2,4-dinitrodiphenylamine, 1,5-dinitronaphthalene, 4-nitrobiphenyl, 9,10-dicyanoanthracene and 3,5-dinitrobenzonitrile. Also, it is preferable that the content of the electron acceptor is 0.05~0.5 wt % based on the total weight of the photoconductive composition. The electron acceptor can form the optimal charge transmitting complex with the electron donor within the above range of the content.

The charge transmitting substance of the present invention can be selected without limitation. However, preferably, triphenylamine derivative is used as the charge transmitting substance. Also, it is preferable that the weight of the charge transmitting substance is 0.5~5 wt % based on the total weight of the photoconductive composition. The charge mobility of the charge transmitting substance is desirably maintained within the above range.

The binder of the present invention is at least one selected from the group consisting of polystyrene, styrene-butadione copolymer, polymethylmethacrylate polyalphamethylstyrene, styrene-methylmethacrylate copolymer, polybutadiene, polycarbonate and derivatives thereof. Preferably, the binder is a mixture of polybutadiene as the essential constituent, and at least one selected from the group consisting of polystyrene, styrene-butadiene copolymer, polymethylmethacrylate, polyalphamethylstyrene, styrene-methylmethacrylate copolymer, polycarbonate and derivatives thereof. The reason for using the mixture is because the mixture scarcely generate the residues from the binder after a sintering process. Here, preferably, the content of the binder is 5~15 wt % based on the total weight of the photoconductive composition.

When coating the photoconductive composition on a panel of a CRT, it is preferable to add a small amount of surfactant in order to reduce the surface tension of the photoconductive composition. Here, as the surfactant, Silicon silar 100 (General Electronics) or Pluronic P-84 (BASF) is used. Also, preferably, the content of the surfactant is 0.001~0.01 wt % based on the total weight of the photoconductive composition. When the above range of the surfactant is added, the surface tension of the photoconductive composition is minimized.

The solvent for a photoconductive composition can be used without limitation. However, preferably, chloroform, dichloromethane, 1,2-dichloroethane, toluene or xylene is used. The content of the solvent is determined by subtracting the content of the electron donor, electron acceptor, charge transmitting substance, binder and surfactant from the total content (i.e. 100 wt %) of the photoconductive composition.

Hereinafter, a method of forming a phosphor screen of a CRT by an electrophotographic technique, using the photoconductive composition, according to a preferred embodiment of the present invention will be described.

After cleaning an inner surface of a CRT panel, the conductive composition is coated on the panel to form a conductive layer. The conductive layer, which serves to flow electricity generated from. a photoconductive layer coated by the following step, may be formed of an inorganic conductor such as tin oxide, indium oxide and indium tin oxide, or an organic conductor such as quaternary ammoniun salts. However, it is preferable to use the organic conductor as the conductive composition in consideration of the thermal decomposition property during the sintering process.

A photoconductive composition containing 0.5~5 wt % of electron donor represented by the formula (1), 0.05~0.5 wt % of electron acceptor, 0.5~5 wt % of charge transmitting substance, 5~15 wt % of binder, 0.001~0.01 wt % of surfactant and the balance of solvent is coated on the conductive layer and then dried to form a photoconductive layer. Here, preferably, the photoconductive layer is coated to a 2~6 $\mu$m in thickness. In order to prevent swelling of an aluminum layer after a sintering process, the photoconductive layer should be formed in a thickness not more than 6 $\mu$m.

The photoconductive layer is electrified with a corona charger and a predetermined portion thereof is exposed through a shadow mask. After the exposed portion of the photoconductive layer is controlled to be an electrically neutral condition, a first-color phosphor composition is adhered to the exposed portion thereof. Then, the phosphor composition is semi-solidified to the CRT panel using a highly-volatile solvent such as acetone and alcohol.

The above process is repeated by using second- and third-color phosphor compositions instead of the first-color phosphor composition so that the second- and third-color phosphor compositions are adhered to the exposed portion of the CRT panel, respectively.

Then, second- and third-color phosphor compositions are semi-solidified to the CRT panel in sequence using a highly-volatile solvent such as acetone and alcohol, and then a phosphor layer is completed by fusing the first-, second- and third-phosphor compositions on the resulting CRT panel using an infrared heater.

Hereinafter, a method of forming barrier walls of a plasma display device by an electrophotographic technique, using the photoconductive composition, according to another embodiment of the present invention will be described.

First, address electrodes 22 are formed on a rear substrate 21 by a photolithography.

Then, materials for forming a dielectric layer is coated on the rear substrate 21 having the address electrodes 22, and then dried to form a dielectric layer 23. Here. the dielectric layer 23 is formed by a general spin-coating method or printing method, and the material for forming the dielectric layer is the same as that of the conventional one.

A conductive composition is coated on the rear substrate 21 on which the address electrodes 22 and the dielectric layer 23 are sequentially formed, and then dried to form a conductive layer 24. Here, the same composition used to form the phosphor screen of the CRT is used to form the conductive layer.

Figure 2A:
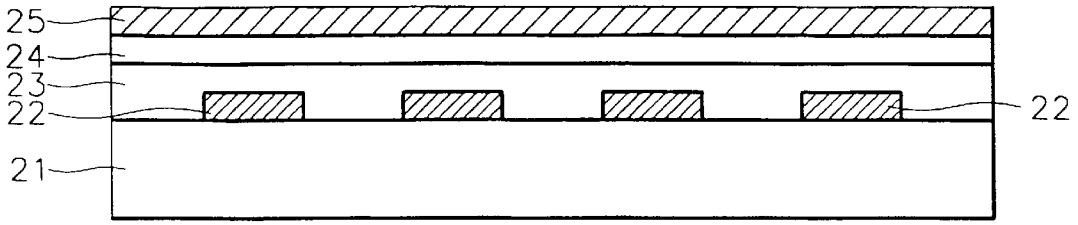
FIGS. 2A through 2E are section views illustrating a method of forming barrier walls of a plasma display device by an electrophotographic technique, using a photoconductive composition, according to an embodiment of the present invention.
Figure 2B:
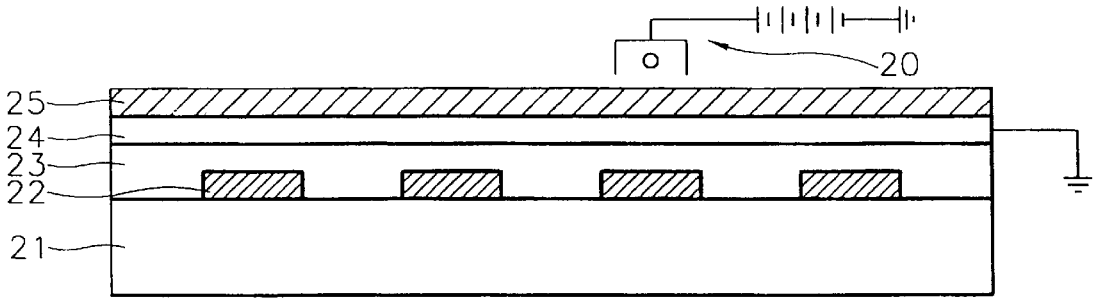

A photoconductive composition containing 0.5~5 wt % of electron donor represented by the formula (1), 0.05~0.5 wt % of electron acceptor, 0.5~5 wt % of charge transmitting substance, 5~15 wt % of binder, 0.001~0.01 wt % of surfactant and the balance of solvent is coated on the conductive layer 24 and then dried to form a photoconductive layer 25 (see FIG. 2A).

Then, the surface of the photoconductive layer 25 is electrified. Here, the surface of the photoconductive layer 25 is electrified with a tungsten (W) wire or scoroton 20 to thus form a positive charge. Here, the conductive layer 24 is maintained in a ground condition (see FIG. 26).

Figure 2C:
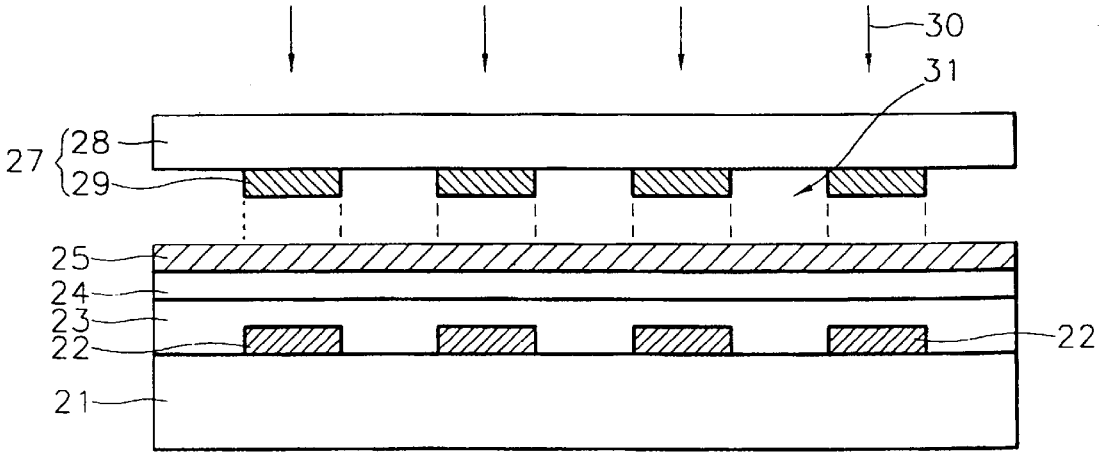

A mask 27 for exposure is spaced apart from the surface of the photoconductive layer 25 by a predetermined interval, and then ultraviolet rays 30 are irradiated onto a predetermined portion of the photoconductive layer 25 by using the mask 27. The mask 27 is obtaind by forming a chromium (Cr) layer pattern 29 on the surface of a glass substrate 28. The Cr layer pattern 29, which matches up to a pattern of barrier walls to be formed later, blocks the ultraviolet rays for exposure. A positive charge is eliminated from the predetermined portion of the photoconductive layer, which is exposed to the ultraviolet rays, thereby forming an electrostatic latent image 31 in a predetermined pattern (see FIG. 2C).

Figure 2D:
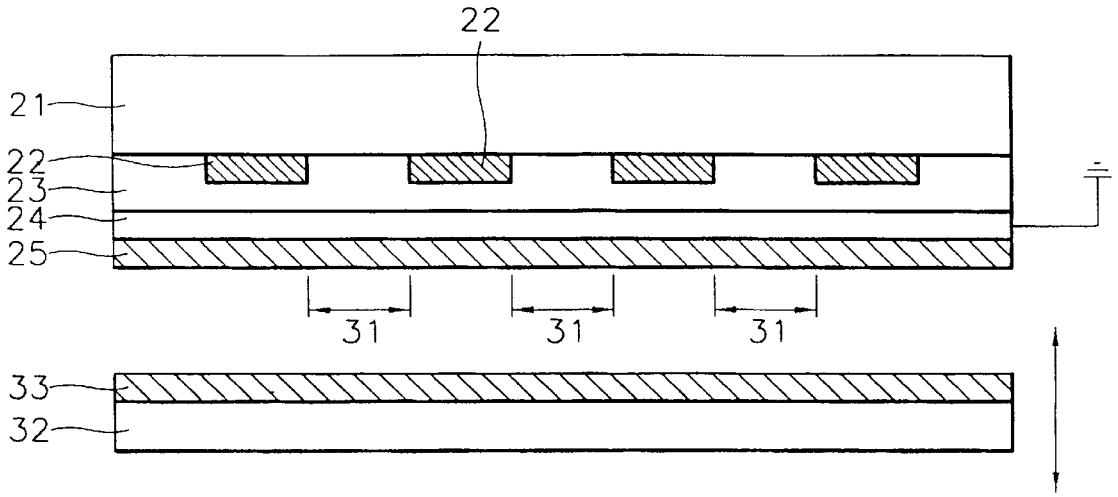

The surface of the photoconductive layer 25 having the electrostatic latent image is developed using a toner composition as a composition for forming the barrier walls. During the developing process, lower electrodes 32 ascend toward the photoconductive layer 25 of the substrate 21, filling a gap formed between the photoconductive layer 25 and the lower electrodes 32 with the toner composition. Under those conditions, the toner composition is attached to the electrostatic latent image 31 of the photoconductive layer 25 (see FIG. 2D). Here, the toner composition is electrified with a positive charge.

The toner composition contains a frit, a binder and a solvent. Here, the frit is at least one selected from the group consisting of titanium oxide, zirconium oxide, alumina, lead oxide, boron oxide and silicon oxide. Here, when the development process is repeated twice or more, the composition of the frit is preferably varied every development process. When the composition of the fit varies, cracking caused when the completed barrier walls are deformed by a thermal expansion is prevented.

After developing the photoconductive layer 25, the toner composition adhered to the electrostatic latent image of the photoconductive layer 25 is dried to be fixed, and the toner composition dispersed over the portion other than the electrostatic latent image is removed under vacuum condition.

The above steps from the steps of electrifying the photoconductive layer to the step of removing the toner composition remaining in the portion other than the electrostatic latent image are repeated twice or more, preferably, three times.

During the second and third electrification processes of the photoconductive layer, the surface of the photoconductive layer having the barrier walls formed in the first development step is electrified to a predetermined potential. After these electrification processes, the level of the surface potential is the highest at the upper surface of the barrier walls, and decreased in sequence of the side of the barrier walls and the portion of the photoconductive layer without the barrier walls.

On the other hand, the second and third exposing steps may be performed using a mask in the same manner as the first exposing step, or without mask.

Figure 2E:
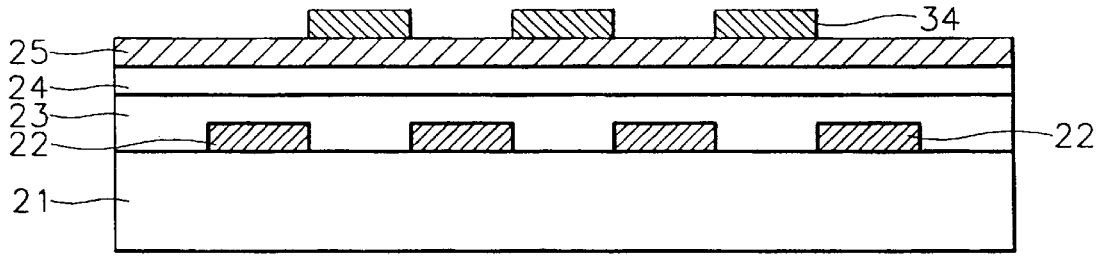

After repeating the step of removing the toner composition which has remained on the photoconductive layer from the electrification step, the rear substrate 21 is sintered to form barrier walls 34 (see FIG. 2E). Here, the sintering is performed at 500~600° C. for 20~40 minutes, preferably, at 550° C. for 30 minutes. During the sintering process, the binder contained in the composition for forming the barrier walls is removed, and the conductive layer 24 and the photoconductive layer 25 formed on the dielectric layer 23 are also removed. The frit of the barrier walls is partially softened by the heat applied during the sintering process. thereby stably fixing the barrier walls 34 to the dielectric layer 23. After the sintering process, a thermal process is performed in order to stabilize the barrier walls 34.

In the above-described method of forming a plasma display device, the surface of the photoconductive layer is electrified with a positive charge, and a mask having a Cr layer pattern at a portion in which the barrier walls are to be formed later is spaced apart from the photoconductive layer by a predetermined interval. However, the opposite case can cause the same result. That is, the surface of the photoconductive layer may be electrified with a negative charge, and the mask having the Cr layer pattern at a portion other than the portion in which the barrier walls are to be formed is spaced apart from the photoconductive layer by a predetermined interval.

Hereinafter, examples of a display device adopting the photoconductive layer according to the present invention will be described. However, the present invention is not limited to the following examples.

EXAMPLE 1

After cleaning an inner surface of a CRT panel, a conductive layer was coated thereon. A photoconductive composition containing 25 g of 1,4-diphenyl-1-butene-3-yne, 2.5 g of 2.4-dinitroaniline, 25 g of triphenylamine, 250 g of polystyrene, 0.1 g of Silicon silar 100 and 2,595 g of toluene was coated on the conductive layer, and then dried, resulting in a photoconductive layer having approximately 4 $\mu$m in thickness.

The photoconductive layer was electrified with a corona charger, to obtain a surface potential between 400V and 600V.

A predetermined portion of the photoconductive layer was exposed using a shadow mask. After neutralizing the charge of the exposed portion, a green phosphor composition was adhered to the exposed portion. Then, the resultant was semi-solidified using acetone.

Then, the photoconductive layer was electrified again with a corona charger. Then, a predetermined portion of the photoconductive layer was exposed by using a shadow mask. After neutralizing the charge of the exposed portion, a blue phosphor composition was adhered to the exposed portion. Then, the resultant was semi-solidified using acetone.

The above process is repeated by using a powdered red phosphor composition instead of the blue phosphor composition, thereby resulting in a red phosphor composition semi-fixed by acetone.

The green-, blue- and red phosphor compositions were fused on CRT panel using an infrared heater, to form a phosphor screen.

EXAMPLE 2

A phosphor screen was formed by the same method as Example 1, except that a photoconductive composition was used, which contains 27 g of 1-pheny-4-para-anisyl-1-butene-3-yne, 2.5 g of 2,4-dinitroaniline, 25 g of triphenylamine, 250 g of polystyrene, 0.1 g of Silicon silar 100 and 2,595 g of toluene.

EXAMPLE 3

A phosphor screen was formed by the same method as Example 1, except that a photoconductive composition was used, which contains 27 g of 1-phenyl-4-anilinophenyl-1-butene-3-yne, 2.5 g of 2,4-dinitroaniline, 25 g of triphenylamine, 250 g of polystyrene, 0.1 g of Pluronic P-84 and 2,595 g of a mixture of toluene and 1.2-dichloroethane (2:1 by volume).

EXAMPLE 4

A phosphor screen was formed by the same method as Example 1, except that a photoconductive composition was used, which contains 25 g of 1,4-diphenyl-1-butene-3-yne, 3 g of 5-nitroanthranilonitrile, 25 g of triphenylamine, 260 g of styrene-butadiene copolymer, 0.1 g of Silicon silar 100 and 2,595 g of toluene.

EXAMPLE 5

A phosphor screen was formed by the same method as Example 1, except that a photoconductive composition was used, which contains 25 g of 1-phenyl-4-para-anisyl-1-butene-3-yne, 3 g of 5-nitroanthranilonitrile, 25 g of triphenylamine, 260 g of styrene-butadiene copolymer, 0.1 g of Silicon silar 100 and 2,595 g of toluene.

EXAMPLE 6

A phosphor screen was formed by the same method as Example 1, except that a photoconductive composition was used, which contains 25 g of 1,4-diphenyl-1-butene-3-yne, 2.5 g of 2,4-dinitroaniline, 25 g of triphenylamine, 250 g of a mixture of polystyrene and polybutadiene (1:1 by weight), 0.1 g of Silicon silar 100 and 2,595 g of toluene.

EXAMPLE 7

A phosphor screen was formed by the same method as Example 1, except that a photoconductive composition was used, which contains 27 g of 1-phenyl-4-para-anisyl-1-butene-3-yne, 2.5 g of 2,4-dinitroaniline, 25 g of triphenylamine, 250 g of a mixture of polystyrene and polybutadiene, 0.1 g of Silicon silar 100 and 2,595 g of toluene.

EXAMPLE 8

A fluorescent film was formed by the same method as Example 1, except that a photoconductive composition was used, which contains 27 g of 1-phenyl-4-anilinophenyl-1-butene-3-yne, 2.5 g of 2,4-dinitroaniline, 30 g of triphenylamine, 250 g of a mixture of polystyrene and polybutadiene (1:1 by weight), 0.1 g of Pluronic P-84 and 2,595 g of a mixture of toluene and 1,2-dichloroethane (2:1 by volume).

EXAMPLE 9

A phosphor screen was formed by the same method as Example 1, except that a photoconductive composition was used, which contains 25 g of 1,4-diphenyl-1-butene-3-yne, 3 g of 5-nitroanthranilonitrile, 25 g of triphenylamine, 260 g of a mixture of styrene-butadiene copolymer and polybutadiene (1:1 by weight), 0.1 g of Silicon silar 100 and 2,595 g of toluene.

EXAMPLE 10

A phosphor screen was formed by the same method as Example 1, except that a photoconductive composition was used, which contains 25 g of 1-phenyl-4-para-anisyl-1-butene-3-yne, 3 g of 5-nitroanthranilonitrile, 25 g of triphenylamine, 260 g of a mixture of styrene-butadione copolymer and polybutadiene (1:1 by weight), 0.1 g of Silicon silar 100 and 2,595 g of toluene.

EXAMPLE 11

A dielectric layer and a conductive layer were formed in sequence on a substrate having an indium tin oxide (ITO) electrode. A photoconductive composition containing 25 g of 1,4-diphenyl-1-butene-3-yne, 2.5 g of 2,4-dinitroaniline, 25 g of triphenylamine, 250 g of polystyrene, 0.1 g of Silicon silar and 2,595 g of toluene was coated on the conductive layer, and then dried, resulting in a photoconductive layer having approximately 4 $\mu$m in thickness.

The surface of photoconductive layer was electrified to a positive charge using a tungsten (W) wire. Here, the conductive layer was maintained in a ground condition. A shadow mask was spaced from the surface of the photoconductive layer by a predetermined interval and then ultraviolet rays were irradiated onto a predetermined portion thereof using the shadow mask. As a result, the positive charge was eliminated from the exposed portion of the photoconductive layer, thereby forming an electrostatic latent image thereon.

Then, the photoconductive layer was developed using a first toner composition. That is, after electrifying the first toner composition with a positive charge, the first toner composition was adhered to the electrostatic latent image of the photoconductive layer.

The first toner composition was prepared by the following method. That is, lead oxide (PbO), manganese oxide (MnO) and zinc oxide (ZnO) were mixed in 3:4:3 by weight to obtain a frit. Then, the frit was mixed with polymethacrylic acid in 3:7 by weight, and 1 g of the resultant mixture was mixed with 20 g of isoparaffin, thereby preparing the first toner composition.

Then, the first toner composition remaining on the photoconductive layer was removed inhaling under vacuum conditions, and the first toner composition adhered to the electrostatic latent image of the photoconductive layer was dried to fix the first toner composition to the electrostatic latent image of the photoconductive layer.

The steps between the step of electrifying the photoconductive layer and the steps of removing the toner composition remained on the photoconductive layer were repeated using second and third toner compositions in sequence.

Then, the resultant was sintered at about 550° C. for 30 minutes, thereby completing barrier walls.

Here, the second toner composition was prepared by the following method. That is, lead oxide, copper oxide (CuO), manganese oxide (MnO) and chromium oxide (CrO) were mixed in 30:25:30:15 by weight, and the obtaind mixture was mixed with polymethacrylic acid in 3:7 by weight. Then, 1 g of the resultant was mixed with 20 g of isoparaffin, thereby preparing the second toner composition.

The third toner composition was prepared by the following method. That is, lead oxide (PbO), diboron trioxide ($B_2O_3$) and aluminum oxide ($Al_2O_3$) were mixed in 35:25:40 by weight, and the mixture was mixed with polymethacrylic acid in 3:7 by weight. Then, 1 g of the resultant was mixed with 20 g of isoparaffin.

EXAMPLE 12

Barrier walls were formed by the same method as Example 11, except that a photoconductive composition was used, which contains 27 g of 1-phenyl-4-para-anisyl-1-butene-3-yne, 2.5 g of 2,4-dinitroaniline, 25 g of triphenylamine, 250 g of polystyrene, 0.1 g of Silicon silar 100 and 2,595 g of toluene.

EXAMPLE 13

Barrier walls were formed by the same method as Example 11, except that a photoconductive composition was used, which contains 27 g of 1-phenyl-4-anilinophenyl-1-butene-3-yne. 2.5 g of 2,4-dinitroaniline, 25 g of triphenylamine, 250 g of polystyrene, 0.1 g of Pluronic P-84 and 2,595 g of a mixture of toluene and 1,2-dichloroethane (2:1 by volume).

EXAMPLE 14

Barrier walls were formed by the same method as Example 11, except that a photoconductive composition was used, which contains 25 g of 1,4-diphenyl-1-butene-3-yne, 3 g of 5-nitroanthranilonitrile, 25 g of triphenylamine, 260 g of styrene-butadiene copolymer, 0.1 g of Silicon silar 100 and 2,595 g of toluene.

EXAMPLE 15

Barrier walls were formed by the same method as Example 11, except that a photoconductive composition was used, which contains 25 g of 1-phenyl-4-para-anisyl-1-butene-3-yne, 3 g of 5-nitroanthranilonitrile, 259 of triphenylamine, 260 g of styrene-butadiene copolymer, 0.1 g of Silicon silar 100 and 2,595 g of toluene.

EXAMPLE 16

Barrier walls were formed by the same method as Example 11, except that a photoconductive composition was used, which contains 25 g of 1,4-diphenyl-1-butene-3-yne, 2.5 g of 2,4-dinitmaniline, 25 g of triphenylamine. 250 g of a mixture of polystyrene and polybutadiene (1:1 by weight), 0.1 g of Silicon silar 100 and 2,595 g of toluene.

EXAMPLE 17

Barrier walls were formed by the same method as Example 11, except that a photoconductive composition was used, which contains 27 g of 1-phenyl-4-para-anisyl-1-butene-3-yne, 2.5 g of 2,4-dinitroaniline, 25 g of triphenylamine, 250 g of a mixture of polystyrene and polybutadiene, 0.1 g of Silicon silar 100 and 2,595 g of toluene.

EXAMPLE 18

Barrier walls were formed by the same method as Example 11, except that a photoconductive composition was used, which contains 27 g of 1-phenyl-4-anilinophenyl-1-butene-3-yne, 2.5 g of 2,4-dinitroaniline, 30 g of triphenylamine, 250 g of a mixture of polystyrene and polybutadiene (1:1 by weight), 0.1 g of Pluronic P-84 and 2,595 g of a mixture of toluene and 1,2-dichloroethane (2:1 by volume).

EXAMPLE 19

Barrier walls were formed by the same method as Example 11, except that a photoconductive composition was used, which contains 25 g of 1,4-diphenyl-1-butene-3-yne, 3 g of 5-nitroanthranilonitrile, 25 g of triphenylamine, 260 g of a mixture of styrene-butadiene copolymer and polybutadiene (1:1 by weight), 0.1 g of Silicon silar 100 and 2,595 g of toluene.

EXAMPLE 20

Barrier walls were formed by the same method as Example 11, except that a photoconductive composition was used, which contains 25 g of 1-phenyl-4-para-anisyl-1-butene-3-yne, 3 g of 5-nitroanthranilonitrile, 25 g of triphenylamine, 260 g of a mixture of styrene-butadiene copolymer and polybutadiene (1:1 by weight), 0.1 g of Silicon silar 100 and 2,595 g of toluene.

Comparative Example 1

A phosphor screen was formed by the same method as Example 1, except that a photoconductive composition was used, which contains 300 g of polystyrene, 50 g of tetraphenylbutatriene, 2.5 g of 2,4,7-trinitro-9-fluorenone, 0.15 g of Silicon silar 100 and 2,648 g of toluene Comparative Example 2

Barrier walls were formed by the same method as that of Example 11, except that a photoconductive composition containing 300 g or polystyrene, 50 g of tetraphenylbutatriene, 2.5 g of 2,4,7-trinitro-9-fluorenone, 0.15 g of Silicon silar 100 and 2,648 g of toluene was used.

Photoconductive compositions of Example 1 through 20 and Comparative Examples 1 through 2 were coated on the inner surface of a CRT panel and on the rear substrate and then sintered, and the resultant was investigated each case.

As a result, a great amount of residue was left after the sintering process as much as visually detected in the cases of Comparative Examples 1 and 2. On the contrary, in the cases of Examples 1 through 20. the residue was scarcely left and the residual potential was 30 V or lower after the electrification and exposure are repetitively performed.

Particularly, when using the mixture of polybutadiene and polystyrene (Examples 6 through 8, and 16 through 18), or the mixture of polybutadiene and styrene-butadiene copolymer (Examples 9, 10, 19 and 20), as the binder, there are scarcely the residues generated from the binder after the sintering process.

The photoconductive composition of the present invention provides the following effects.

1,4-diphenyl-1-butene-3-yne derivative, as the electron donor of the present invention, has excellent sensitivity and thermal decomposition property. Thus, there are scarcely the residues after the sintering process, so that deterioration of image quality in a display device such as CRT and plasma, caused by the residues, can be effectively prevented. Particularly, when the binder contains polybutadiene as the essential constituent, the residues generated from the binder after sintering process is hardly left due to its excellent thermal decomposition property.

Also, each constituent of the photoconductive composition can be easily synthesized and purchased, so that the composition can be prepared at comparatively low costs.

What is claimed is:

1. A photoconductive composition containing an electron donor, an electron acceptor, a charge transmitting substance, a binder, a surfactant and a solvent, wherein the electron donor is a 1,4-diphenyl-1-butene-3-yne derivative represented by the following formula (1):

(1)

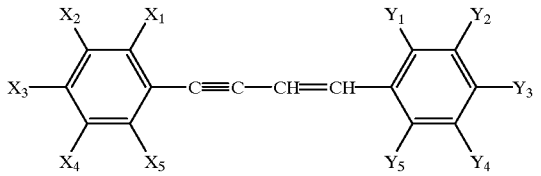

where $X_1$, $X_2$, $X_3$, $X_4$, $X_5$, $Y_1$, $Y_2$, $Y_3$, $Y_4$ and $Y_5$ are the same or different from each other, each being independently selected from the group consisting of hydrogen and alkyl, phenyl, nitro ($NO_2$), $NR_2$, OR and $SiR_3$ groups, and R is hydrogen, alkyl or a phenyl group.

2. The photoconductive composition of claim 1, wherein the electron acceptor is at least one selected from the group consisting of 4-nitroaniline, 2,4-dinitroaniline, 5-nitroanthranilonitrile, 2,4-dinitrodiphenylamine, 1,5-dinitronaphthalene, 4-nitrobiphenyl, 9,10-dicyanoanthracene and 3,5-dinitrobenzonitrile.

3. The photoconductive composition of claim 1, wherein the binder is at least one selected from the group consisting of polystyrene, styrene-butadiene copolymer, polymethylmethacrylate, polyalphamethylstyrene, styrene-methylmethacrylate copolymer, polybutadiene, polycarbonate and derivatives thereof.

4. The photoconductive composition of claim 1, wherein the binder is a mixture of polybutadiene, and at least one selected from the group consisting of polystyrene, styrene-butadiene copolymer, polymethylmethacrylate, polyalphamethylstyrene, styrene-methylmethacrylate copolymer, polycarbonate and derivatives thereof.

5. The photoconductive composition of claim 1, wherein the content of the electron donor is 0.5~5 wt % based on the total weight of the photoconductive composition.

6. The photoconductive composition of claim 1, wherein the content of the electron acceptor is 0.05~0.5 wt % based on the total weight of the photoconductive composition.

7. The photoconductive composition of claim 1, wherein the content of the charge transmitting substance is 0.5~5 wt % based on the total weight of the photoconductive composition.

8. The photoconductive composition of claim 1, wherein the content of the binder is 5~15 wt % based on the total weight of the photoconductive composition.

9. The photoconductive composition of claim 1, wherein the content of the surfactant is 0.001~0.01 wt % based on the total weight of the photoconductive composition.

* * * * *